US006087741A

United States Patent [19]

Båberg

[11] Patent Number: 6,087,741

[45] **Date of Patent: *Jul. 11, 2000**

[54] PROGRAM CONTROLLED SWITCHING DEVICE INSERTABLE INTO A POWER SUPPLY OUTLET

[75] Inventor: Michael Båberg, Stockholm, Sweden

[73] Assignee: Easy-Living Aktiebolag, Hagersten, Sweden

[ * ] Notice: This patent is subject to a terminal disclaimer.

[21] Appl. No.: 08/817,209

[22] PCT Filed: Oct. 11, 1995

[86] PCT No.: PCT/SE95/01173

§ 371 Date: Sep. 26, 1997

§ 102(e) Date: Sep. 26, 1997

[87] PCT Pub. No.: WO96/11428

PCT Pub. Date: Apr. 18, 1996

[30] Foreign Application Priority Data

Oct. 11, 1994 [SE] Sweden ..... 9403447

[51] Int. Cl.[7] ..... H01H 35/00

[52] U.S. Cl. ..... 307/139; 307/116; 307/125; 307/141

[58] Field of Search ..... 307/112, 113, 307/116, 117, 125, 139, 140, 141.9, 141.8; 439/13

[56] References Cited

U.S. PATENT DOCUMENTS

| | | | |
|---|---|---|---|
| 4,172,998 | 10/1979 | Beling et al. | 328/2 |
| 4,213,062 | 7/1980 | Jespersen | 307/117 |
| 4,902,906 | 2/1990 | Murphy | 307/117 |
| 5,077,484 | 12/1991 | Tsai et al. | 307/39 |
| 5,160,853 | 11/1992 | Simon et al. | 307/140 |
| 5,258,656 | 11/1993 | Pawlick | 307/141 |
| 5,374,854 | 12/1994 | Chen | 307/117 |
| 5,598,039 | 1/1997 | Weber | 307/38 |
| 5,673,022 | 9/1997 | Patel | 340/565 |

FOREIGN PATENT DOCUMENTS

| | | |
|---|---|---|
| 2500466A | 7/1976 | Germany . |
| 2922687A | 12/1980 | Germany . |
| 3043936A | 6/1981 | Germany . |
| 448414 | 2/1987 | Sweden . |

*Primary Examiner*—Jeffrey Gaffin
*Assistant Examiner*—Roberto Rios

[57] ABSTRACT

A switching device insertable between an electric outlet and a load closes and breaks a circuit between the outlet and the load at certain points of time or in accordance with other predetermined conditions. The switching device is built up from a circuit board or a similar device which supports a substantial part or all circuits of the device. First connectors for connection to an outlet which provides a supply voltage are arranged perpendicular out from one side of the circuit board. Second connectors for outputting the supply voltage are arranged perpendicular out from an opposite side of the circuit board. The first and second connectors are centered about a same axis and are mounted at locations about the axis by substantially right angles in relation to each other, whereby input and output parts under tension on the board are located at maximum distance from each other with smallest possible board size.

21 Claims, 2 Drawing Sheets

PROGRAM CONTROLLED SWITCHING DEVICE INSERTABLE INTO A POWER SUPPLY OUTLET

BACKGROUND OF THE INVENTION

1. Field of the Invention

The present invention refers to a new structure and function of switching devices of the type that can be placed between an electrical outlet and a load in order to close and/or break the circuit between the outlet and the load at defined times or after occurrence of predetermined conditions.

2. Description of the Background Art.

Switching timers for connection in a wall outlet and with a socket for a plug are well known. These are however cumbersome, mostly because they are provided with devices for setting of times for connection and disconnection. Electro mechanical switching timers are commonly constituted by a ring with tabs or other actuation devices which actuate a switch at times corresponding to the position of the tabs or actuation devices. At electronic switching timers, the actuation generally correspond to different function keys and a display.

SUMMARY OF THE INVENTION

An object of the present invention is to provide switching devices of a for use in a socket and/or with a socket for a plug that are as compact as possible. Further, an object is to eliminate mechanical or other actuation devices which are conventionally required in similar devices to obtain a desired function and to replace such actuation devices with programmed electronic functions in order to faciliate a compact structure. A preferred embodiment of the invention does not include such external actuation devices. These and other objects are accomplished in that the device according to the invention has been provided with a structure and functions according to that will be described in more detail as follows.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described with reference to subsequent drawings, which are given by way of illustration only, and thus are not limitative of the present invention, and wherein.

DETAILED DESCRIPTION OF THE PREFERRED EMBODIMENTS

Figure 1:
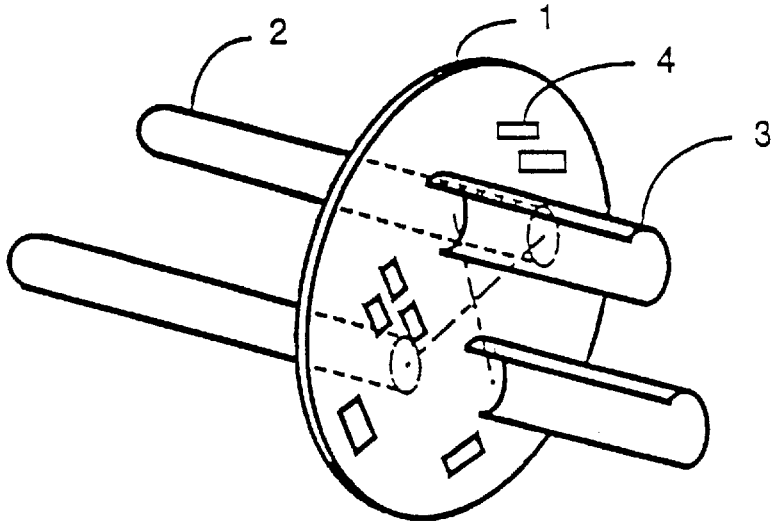
FIG. 1 shows the structure of an embodiment of a device according to the invention.

On a circuit board 1 or a similar device in the form of a disc two male connectors 2 protrude perpendicularly from one side. From the opposite side of the circuit board 1 two female connectors 3 protrude perpendicularly in a corresponding manner. The disc or the circuit board 1 is intended to support components 4 on one or both sides. Preferably the female and male connectors are centered about the same axis but are rotated about the axis at substantially right angles in relation to each other whereby ingaing in and outgoing parts under tension of the board are located at maximum distance from each other with smallest possible board size.

As an alternative embodiment (not shown), one or both of the male connectors or the female connectors are replaced with by other connectors placed at corresponding locations on the board.

All or the main part of circuits 4 which are necessary for the operation of the switching device are placed on the circuit board 1, on one or both sides thereof. A housing round the device connects near the board 1, but with space for components at the with the male connectors 2, and forms a plug connector. At the other side of the device the housing completely surrounds the female connectors 3 and forms a conventional socket side, whereby within the housing there is also space for components protruding further outward from the board 1, thus forming a plug connector. The components which are necessary for the function according to the invention however do not normally require any large space.

Figure 2:
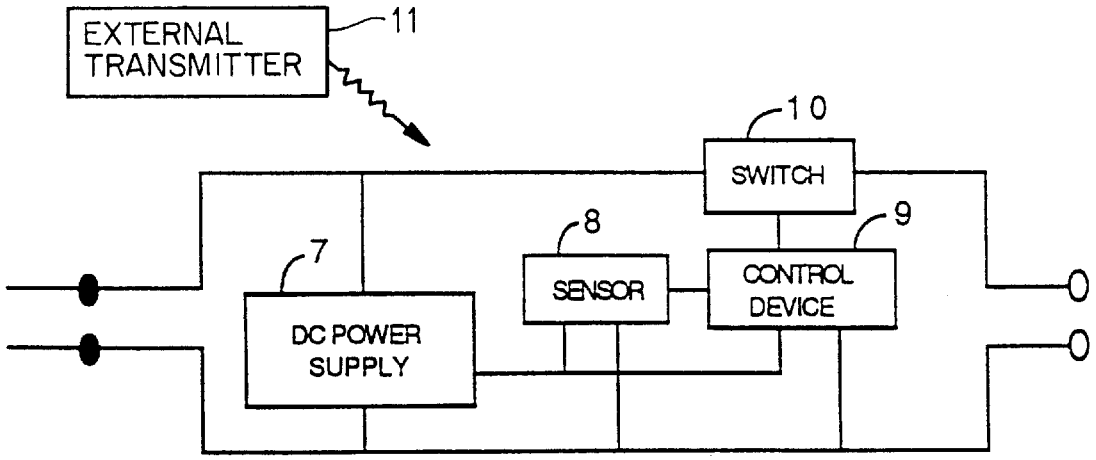
FIG. 2 diagrammatically shows an example of a block diagram of a device according to the invention.

The circuits for control of the operation of the switching device include on one hand one or several switches 10 (FIG. 2) and on the other hand a control device 9 that controls the switching on and off of the switch 10, or the several switches 10, in order to close and/or break the circuit between the input and output side according to predetermined conditions. The control device 9 can be built up from conventional micro electronics and may have the functions indicated in closer detail below.

In addition to these circuits there is a DC power supply 7 for current supply of the circuits and generally a sensor 8 for sensing light, other electromagnetic radiation or sound. An external transmitter 11, which may be a remote control transmitter, is illustrated as transmitting signals which may actuate control device 9. The transmitted signals from external transmitter 11 are detected by sensor 8.

A device according to the invention may be provided with earth grounding connections at the input and the output side, possibly with connection to parts of the circuit board that are to be connected to earth. Similarly, the connectors on the input and the output side may be differently designed than in FIG. 1, for example the connectors or prongs may be flat.

In order to form a compact unit that may be simply inserted between a wall outlet and plug, it also constitutes a part of the invention. That preferably no moving parts or setting devices are included in the switching device. Each switching device should be designed for a special function. In its simplest embodiment the switching device may be designed to keep the outputcircuit connected to the input during a predetermined fixed time after the switching device has been plugged into the wall outlet and that this period is repeated every 24 hours. Such a device can be used for example for lighting or for a car heater. It can also be used as a safety shut down for electrical devices such as water heaters, coffee makers and flat irons, whereby only the off-switching function is performed a certain time period after connection. This embodiment could be used with electrical devices which do not have built in 24-hour repetition timers for controlling shut off.

A particularly advantageous embodiment of the present invention is obtained when a sensor for detection of daylight is provided and that the control device is designed to sense when the daylight ceases and returns. The sensor 8 for detection of daylight as illustrated generally in FIG. 1 may be constituted by one or several photo sensitive sensors that are placed on the circuit board 1. One or several light guides may be arranged from the sensor or the sensors to the outside of the housing or the housing can also be made of a material that is light permeable to the extent to make it possible that suitable frequencies of the daylight will be able to reach the sensor from outside. Several plastic materials let through enough light for daylight detection. The sensors are in a known manner connected such that threshold levels can be sensed and provided to the control device 9. In order to distinguish the variations of the daylight from other light changes the control device is a threshold value circuit or other circuits arranged to react only to the slow changes that daylight exhibits, and to filter off more rapid changes in light for example, control device 9 may function in accordance with the algorithm shown in FIG. 3.

Figure 3:
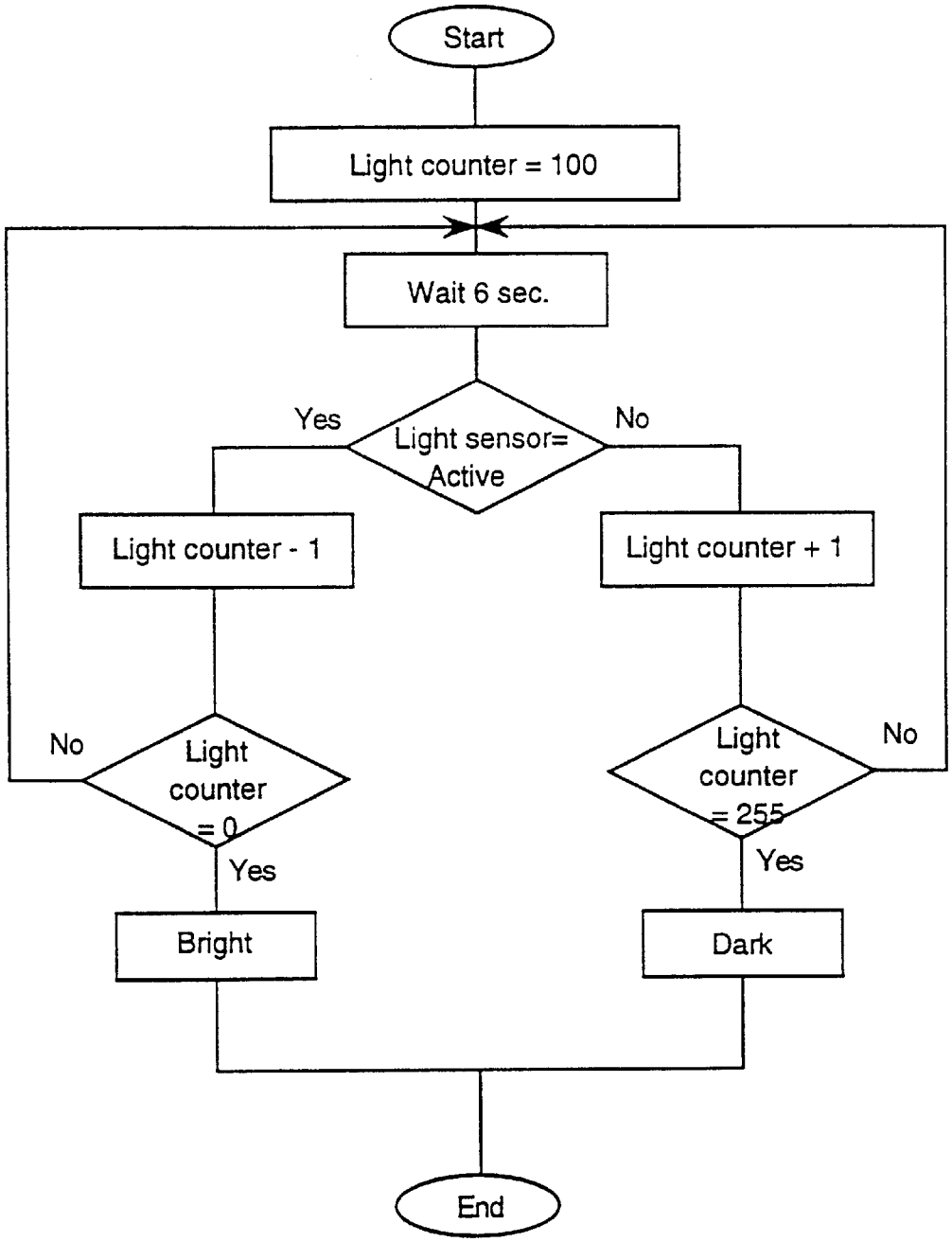
FIG. 3 shows an example of an algorithm which can be used in a program for calculation when dawn and dusk occur.

An example of an algorithm that may be used in a program for calculation when dawn and dusk occur is shown in FIG. 3. This can be used for example in a one chip computer of the type 68HC05, which may constitute the main component in the control device 9. As can be seen in the flow chart a light counter counts through a number of steps of six seconds up to 255 or down to zero before dark or light is determined, whereby a filter against erroneous detection is obtained. This algorithm is incorporated as a part of the program that controls the switch 10.

In one embodiment of the switching device the control device is designed to connect the supply voltage to the output connectors when daylight ceases and again disconnects the supply voltage from the output connectors at the time of the day when the switching device has been connected, or in other words when the switching device with an electrical device connected thereto is plugged into a power supply outlet. This is repeated on a twenty-four hour basis by the control device being provided with a twenty-four hour timer, which may be constructed as a program module and controlled by the line frequency. The twenty-four hour timer starts when the device is connected and gives a disconnection signal every twenty-four hours.

In a further embodiment of the switching device a timer circuit connected to the control device is adjusted according to the daylight so that the timer circuit is mainly synchronised with the time of the day independently of where or at what time of night and day or the year that the switching device is connected. The timer circuit connected to the control device is self adjusted by automatically setting a time midway between a times when daylight ceases and a time when daylight returns as midnight. The control device can be designed such that it activates the switch when the daylight ceases and activates it again when the adjusted timer circuit indicates a predetermined time of the day. Before the timer circuit is adjusted, that is during the first day and night that the device is connected, switching off may be carried out according to a fixed programmed time.

In a still further embodiment of the switching device according to the invention, it is provided with means for a random connection and disconnection of the circuit. The object of such a design can for example be to give the impression that there are people in a habitation or premises thereby in order to prevent burglary attempts. This embodiment is preferably combined with any of the above stated functions so that the random connection and disconnection only occurs when the circuit otherwise should be closed.

Another embodiment of the invention is designed such that a sensor is adapted to sense signals from an external transmitter or remote control so that the signals from this may actuate a switch to turn on, put out or control the supply voltage of a lamp, or actuate other functions in the program of the control device, whereby these functions may be controlled without the switching device having to be touched or being provided with keys or other connection elements.

Through the invention a very compact structure of switching devices of the type including timers and similar control devices is achieved. Functions that previously only could be provided by means of bulky apparatuses can be built into housings that are only slightly bigger than a plug in accordance with the preferred embodiments.

The invention as described with reference to various embodiments is intended to meet various requirements of functions for time and sensor controlled switches. Within the scope of the invention there are also various combinations of the functions described in the embodiments.

What is claimed is:

1. A switching device insertable between an electric outlet and a load, the switching device comprising:

a switch;

electronic circuits;

a control device included in and controlling said electronic circuits according to predetermined conditions; and a circuit board that supports a substantial part of said electronic circuits, said circuit board supporting two male connectors connectable to a supply voltage and being arranged substantially perpendicular out from a first side of said circuit board and two female connectors for supplying an output voltage and being arranged substantially perpendicular out from an opposite second side of said circuit board, said male and female connectors being centered about an axis perpendicular to said circuit board and being mounted on said circuit board at locations about the axis at substantially right angles in relation to each other.

2. The switching device according to claim 1, wherein said control device is connected to means for detecting daylight, said control device sensing when daylight ceases and returns in accordance with said means for detecting.

3. The switching device according to claim 2, wherein said control device connects the supply voltage to said female connectors when daylight ceases and disconnects the supply voltage from said female connectors twenty-four hours after a time of day when the switching device was inserted into the electric outlet.

4. The switching device according to claim 2, wherein said control device comprises a timer module that is self-adjusted after daylight to be synchronized with time of day independently of where and what time of day and year the switching device is inserted into the electric outlet.

5. The switching device according to claim 4, wherein said timer module is automatically self-adjusted by setting a time midway between a time when daylight ceases and a time when daylight returns as midnight.

6. The switching device according to claim 4 or 5, wherein said control device actuates said switch when daylight ceases and reactuates it when said timer module as self-adjusted indicates a predetermined time of day.

7. The switching device according to claim 1, further comprising means for random connection and disconnection of the supply voltage and said female connectors.

8. The switching device according to claim 1, further comprising sensor means for detecting signals from an external transmitters, said control device being actuable in accordance with the signals received by said sensor means.

9. The switching device according to claim 2, further comprising means for random connection and disconnection of the supply voltage and said female connectors.

10. The switching device according to claim 3, further comprising means for random connection and disconnection of the supply voltage and said female connectors.

11. The switching device according to claim 4, further comprising means for random connection and disconnection of the supply voltage and said female connectors.

12. The switching device according to claim 5, further comprising means for random connection and disconnection of the supply voltage and said female connectors.

13. The switching device according to claim 6, further comprising means for random connection and disconnection of the supply voltage and said female connectors.

14. The switching device according to claim 3, wherein said control device further comprises a twenty-four hour timer which starts when the switching device is inserted into the electric outlet and generates a turn-off signal every twenty-four hours.

15. A switching device insertable between an electric outlet and a load, the switching device comprising:

a switch;

electronic circuits;

a control device for controlling said electronic circuits according to predetermined conditions; and a circuit board that supports a substantial part of said electronic circuits;

said circuit board also supporting two first connectors connectable to a supply voltage and being arranged substantially perpendicular out from a first side of said circuit board and two second connectors for supplying an output voltage and being arranged substantially perpendicular out from an opposite second side of said circuit board;

said first and second connectors being centered about an axis perpendicular to said circuit board and being mounted on said circuit board at locations about the axis at substantially right angles in relation to each other.

16. The switching device of claim 15, wherein said control device connects the supply voltage to said second connectors when daylight ceases and disconnects the supply voltage from said second connectors every twenty-four hours after a time of day when the switching device was inserted into the electric outlet.

17. The switching device of claim 15, wherein said control device connects the supply voltage to said second connectors when daylight ceases.

18. The switching device of claim 17, wherein said control device comprises a timer module that is self-adjustable after daylight to be synchronized with time of day independently of where and what day and year the switching device is inserted into the electric outlet, said switching device disconnecting the supply voltage from said second connectors every twenty-four hours after a time of day when the switching device was inserted into the electric outlet, after self-adjustment of said timer module to be synchronized with the time of day.

19. The switching device of claim 18, wherein said timer module is automatically self-adjustable by setting a time midway between a time when daylight ceases and a time when daylight returns as midnight.

20. The switching device of claim 17, wherein said control device further comprises a twenty-four hour timer which starts when the switching device is inserted into the electric outlet and generates a turn-off signal every twenty-four hours.

21. The switching device of claim 15, wherein said first connectors are male connectors and said second connectors are female connectors.

* * * * *